US007418221B2

(12) United States Patent
Kyung et al.

(10) Patent No.: US 7,418,221 B2
(45) Date of Patent: Aug. 26, 2008

(54) TRANSFER UNIT USED WITH IMAGE FORMING APPARATUS

(75) Inventors: Myung-ho Kyung, Suwon-si (KR); Mun-bae Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 11 days.

(21) Appl. No.: 10/941,901

(22) Filed: Sep. 16, 2004

(65) Prior Publication Data

US 2005/0084291 A1 Apr. 21, 2005

(30) Foreign Application Priority Data

Oct. 21, 2003 (KR) ..... 2003-73276

(51) Int. Cl.
*G03G 15/08* (2006.01)

(52) U.S. Cl. ..... 399/121; 399/308; 399/313

(58) Field of Classification Search ..... 399/121, 399/308, 313, 66, 359
See application file for complete search history.

(56) References Cited

U.S. PATENT DOCUMENTS 5,140,369 A * 8/1992 Haneda et al.
5,440,373 A * 8/1995 Deki et al.
5,587,769 A * 12/1996 Sawada et al. ..... 399/113
5,612,771 A * 3/1997 Yamamoto et al. ..... 399/121
5,617,195 A * 4/1997 Torimaru et al.
5,778,291 A * 7/1998 Okubo et al. ..... 399/302
5,887,228 A * 3/1999 Motohashi et al. ..... 399/111
5,983,062 A * 11/1999 Sameshima ..... 399/302
6,115,568 A * 9/2000 Sameshima ..... 399/110
6,185,396 B1 * 2/2001 Aizawa et al. ..... 399/121
6,249,656 B1 * 6/2001 Watanabe et al. ..... 399/66
6,324,374 B1 * 11/2001 Sasamoto et al.

(Continued)

FOREIGN PATENT DOCUMENTS

JP 07-72744 3/1995

(Continued)

OTHER PUBLICATIONS

Japanese Office Action dated Oct. 24, 2006 issued in JP 2004-307225.

(Continued)

*Primary Examiner*—David M. Gray
*Assistant Examiner*—Laura K Roth
(74) *Attorney, Agent, or Firm*—Stanzione & Kim, LLP

(57) ABSTRACT

A transfer unit used with an image forming apparatus includes an upper housing having a transfer belt of an endless track structure to transfer an image from a photoconductive unit of a main body of the image forming apparatus, and a plurality of rollers to support the transfer belt to rotate therein, and a lower housing removably connected to the upper housing, and having a cleaning unit to clean the transfer belt. The transfer unit is removably mounted to the main body of the image forming apparatus. Accordingly, the transfer unit is facile to be connected to and separated in a vertical direction from the main body of the image forming apparatus. Further, it is convenient to replace the transfer unit since the relative position thereof can be controlled with respect to a contacting object, such as the photoconductive unit.

53 Claims, 10 Drawing Sheets

U.S. PATENT DOCUMENTS

| | | | | |
|---|---|---|---|---|
| 6,611,672 | B2 * | 8/2003 | Aoki et al. | 399/359 |
| 6,738,590 | B2 * | 5/2004 | Okimura et al. | 399/111 |
| 7,054,578 | B2 * | 5/2006 | Jung et al. | 399/121 |
| 7,130,561 | B2 * | 10/2006 | Iikura et al. | 399/121 |
| 2002/0021916 | A1 * | 2/2002 | Wakana | 399/121 |
| 2003/0035664 | A1 * | 2/2003 | Takahata et al. | 399/302 |
| 2003/0086732 | A1 * | 5/2003 | Abe et al. | |
| 2004/0009008 | A1 * | 1/2004 | Park et al. | 399/121 |
| 2004/0170450 | A1 * | 9/2004 | Hamano et al. | |

FOREIGN PATENT DOCUMENTS

| | | | |
|---|---|---|---|
| JP | 07-199678 | | 8/1995 |
| JP | 08-305252 | | 11/1996 |
| JP | 09-81004 | | 3/1997 |
| JP | 2001-201915 | | 7/2001 |
| JP | 2001249522 | A * | 9/2001 |
| JP | 2003-76155 | | 3/2003 |
| JP | 2003-271037 | | 9/2003 |
| JP | 2003-295724 | | 10/2003 |
| KR | 1998-10650 | | 4/1998 |

OTHER PUBLICATIONS

Japanese Office Action dated Feb. 20, 2007 issued in JP 2004-307225.

* cited by examiner

TRANSFER UNIT USED WITH IMAGE FORMING APPARATUS

CROSS-REFERENCE TO RELATED APPLICATIONS

This application claims the benefit of Korean Application No. 2003-73276, filed Oct. 21, 2003, in the Korean Intellectual Property Office, the disclosure of which is incorporated herein by reference.

BACKGROUND OF THE INVENTION

1. Field of the Invention

The present general inventive concept relates to a transfer unit used with an image forming apparatus, and more particularly, a transfer unit detachably mounted in a vertical direction in an image forming apparatus and having a transfer belt of an endless track structure to transfer an image from a photoconductive unit of a main body of the image forming apparatus, an upper housing having a plurality of rollers to support the transfer belt and move therein, and a lower housing having a cleaning unit of the transfer belt.

2. Description of the Related Art

Generally, an image forming apparatus, i.e., a printer or a photocopier, includes a transfer unit to receive a developed image and transfer the received developed image to a paper. As the transfer unit is used a long period of time, accuracy thereof gradually deteriorate. Therefore, to guarantee a clearly developed image, the transfer unit needs to be replaced with a new one after a predetermined life span of the transfer unit.

Further, it is preferable that the transfer unit has a simple structure to be handled with ease in connecting and separating. Therefore, many researches on the transfer unit are under way.

FIG. 1 is a schematic view of a general conventional image forming apparatus having a transfer unit 20.

As shown in FIG. 1, the image forming apparatus having the transfer unit 20 includes a photoconductive unit 11, a laser scanning unit 12, a developing apparatus 13, a transfer belt 14, a plurality of rollers 15 for circulating the transfer belt 14 along an endless track, a first transfer roller 16 for transferring an image to the transfer belt 14, a second transfer roller 17 for transferring the image onto a paper, and a fusing roller 18 for fusing the image. The above apparatus operates in association with one another to perform electrifying, laser scanning, developing, transferring, and fusing in regular sequence. Accordingly, a desired image is obtained on the paper.

FIG. 2 shows a general conventional transfer unit of the conventional image forming apparatus of FIG. 1.

As shown in FIG. 2, the transfer unit 20 is supported by a guide rail 42 provided in the image forming apparatus to slide thereon. In addition, the transfer unit 20 includes a transfer housing 23 which constitutes an exterior of the transfer unit 20, a transfer belt 14 disposed in the transfer housing 23, and a plurality of rollers 15, 16, 17 provided to support the transfer belt 14.

A guide member 35 is formed outside the transfer housing 23 to slide along the guide rail 42. At a lower part of the transfer unit 20, the photoconductive unit 11 (FIG. 1) is mounted. The image formed at the photoconductive unit 11 is transferred to the transfer unit 20.

In order to replace the above-structured transfer unit 20 with a new one, a user should open a door (not shown) mounted on a main body (not shown) of the image forming apparatus, separate the photoconductive unit 11 from the main body using a lever (not shown) formed at the main body, pull a first handle 21 of the transfer unit 20 along the guide rail 42 to withdraw the transfer unit 20 from the image forming apparatus.

At this time, when the transfer unit 20 is withdrawn by a predetermined extent, the user unfolds a second handle 22 formed on an upper surface of the transfer unit 20, and grabs the second handle 22 not to drop the transfer unit 20. Mounting of a new transfer unit is performed in the reverse order.

However, in using the transfer unit 20 of the above structure, the user grabs and pulls the handle 21 whenever separating or mounting the transfer housing 23. Therefore, if the user handles the transfer housing 23 carelessly, i.e., pulling the transfer housing 23 too roughly, there is a risk of damaging the transfer housing 23 by dropping it when the guide member 35 is separated from the guide rail 42.

In addition, when mounting or separating the transfer housing 23 with respect to the main body (not shown), the user should hold the first and the second handles 21 and 22 with both hands to move the transfer housing 23 left and right. Thus, the replacing process of the transfer housing 23 becomes troublesome.

SUMMARY OF THE INVENTION

In order to overcome the above-mentioned and/or other problems, it is an aspect of the present general inventive concept to provide a transfer unit used with an image forming apparatus having an improved structure to provide a more secure and facile operation in replacing and mounting the transfer unit, and capable of controlling a position thereof with respect to a contacting object, such as a photoconductive unit.

Additional aspects and advantages of the present general inventive concept will be set forth in part in the description which follows and, in part, will be obvious from the description, or may be learned by practice of the general inventive concept.

In order to achieve the above-described and/or other aspects of the present general inventive concept, there is provided a transfer unit used with an image forming apparatus, the transfer unit including an upper housing having a transfer belt of an endless track structure to transfer an image from a photoconductive unit of a main body of the image forming apparatus, and a plurality of rollers to support the transfer belt and move therein, and a lower housing removably connected to the upper housing and having a cleaning unit to clean the transfer belt. The transfer unit is removably mounted to the main body of the image forming apparatus.

The upper housing and the lower housing are connected to each other when being mounted in a mounting portion of the main body of the image forming apparatus. The plurality of rollers include a transfer roller disposed to correspond to the photoconductive unit, a drive roller disposed to correspond to a transfer medium to transfer the image of the transfer belt thereto, a tension roller to control a tension of the transfer belt, a nip roller to rotate and idle according to a rotation of the drive roller, and at least one support roller.

In an aspect of the present general inventive concept, the upper housing may further include an upper housing body having a first and a second vertical walls that rotatably support the respective rollers, and a cover wall that connects the first and second vertical walls and encloses a side of the transfer belt for protection. The first and the second vertical walls each have a guide slot to guide a movement of the tension roller.

In an aspect of the present general inventive concept, the upper housing can be mounted with the guide slot, and may further include a second tension member to control the tension of the transfer belt. A piece may be further disposed between the second tension member and the guide slot.

In an aspect of the present general inventive concept, tension of the transfer belt can be smaller when the piece is mounted in the transfer unit, than when the piece is removed from the transfer unit. The upper housing may further include a guide member which guides a mounting position of the transfer unit when being mounted in the main body of the image forming apparatus.

In an aspect of the present general inventive concept, the guide member may include a first guide member connected to both ends of one of the rollers and a second guide member connected to both ends of another one of the rollers. The upper housing may further include a first tension member to press the transfer roller toward the photoconductive unit.

In an aspect of the present general inventive concept, a gap ring can be formed at both ends of the transfer roller to maintain a contacting distance between the transfer belt and the photoconductive unit. The upper housing may have a rotatable handle member at an upper part. The upper housing may further include a sensor to sense a running position of the transfer belt. The lower housing may include a lower housing body connected to a lower part of the upper housing to support the cleaning unit, a collecting unit mounted in the lower housing body to collect a cleaned waste toner, and an image density sensor mounted at a lower part of the lower housing body to sense density of the image of the photoconductive unit.

The cleaning unit can be movably mounted in the lower housing body to be selectively in contact with or separated from the transfer belt, and the lower housing body may include a pivot member to drive the cleaning unit. The lower housing may further include a driving force transmitting unit having a plurality of rotatable gears operating in association with one another at a side of the lower housing body. The driving force transmitting unit may transfer a driving force from one of the rollers of the upper housing to the collecting unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
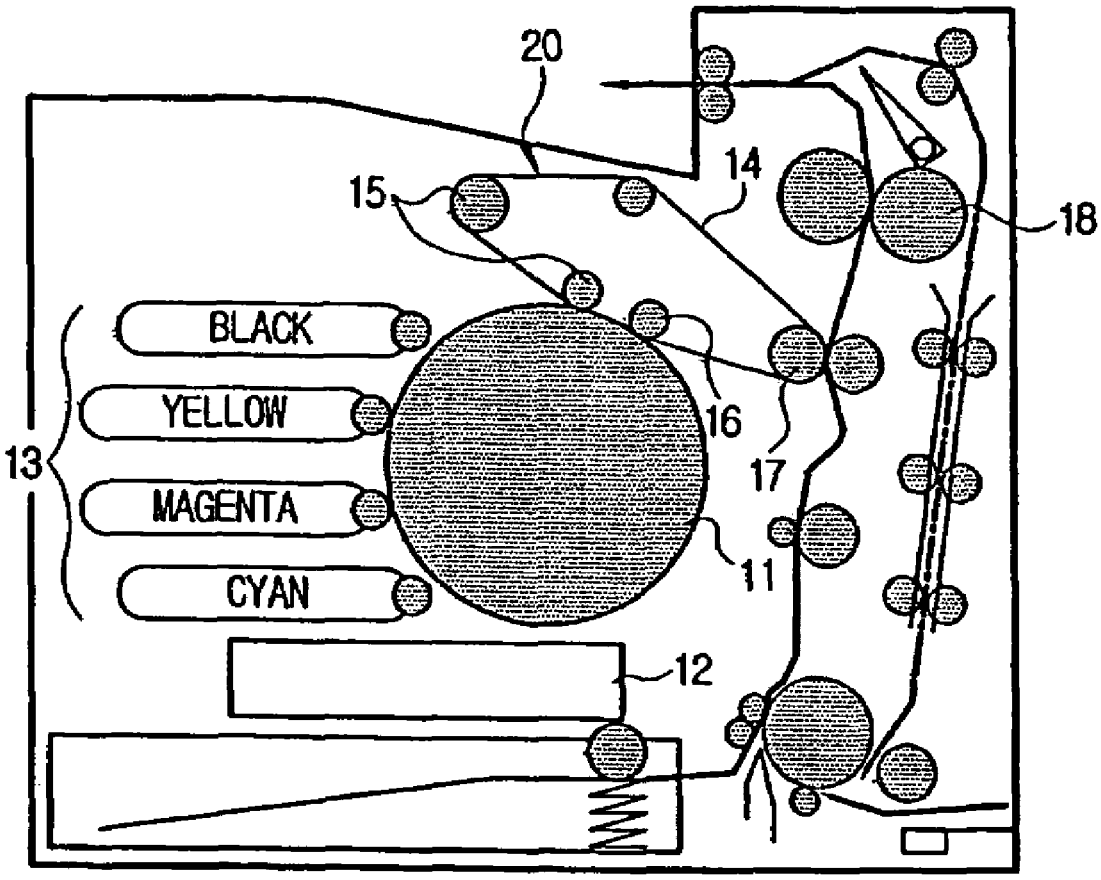
FIG. 1 (PRIOR ART)
FIG. 1 is a schematic view of an image forming apparatus having a general conventional transfer unit.
Figure 2:
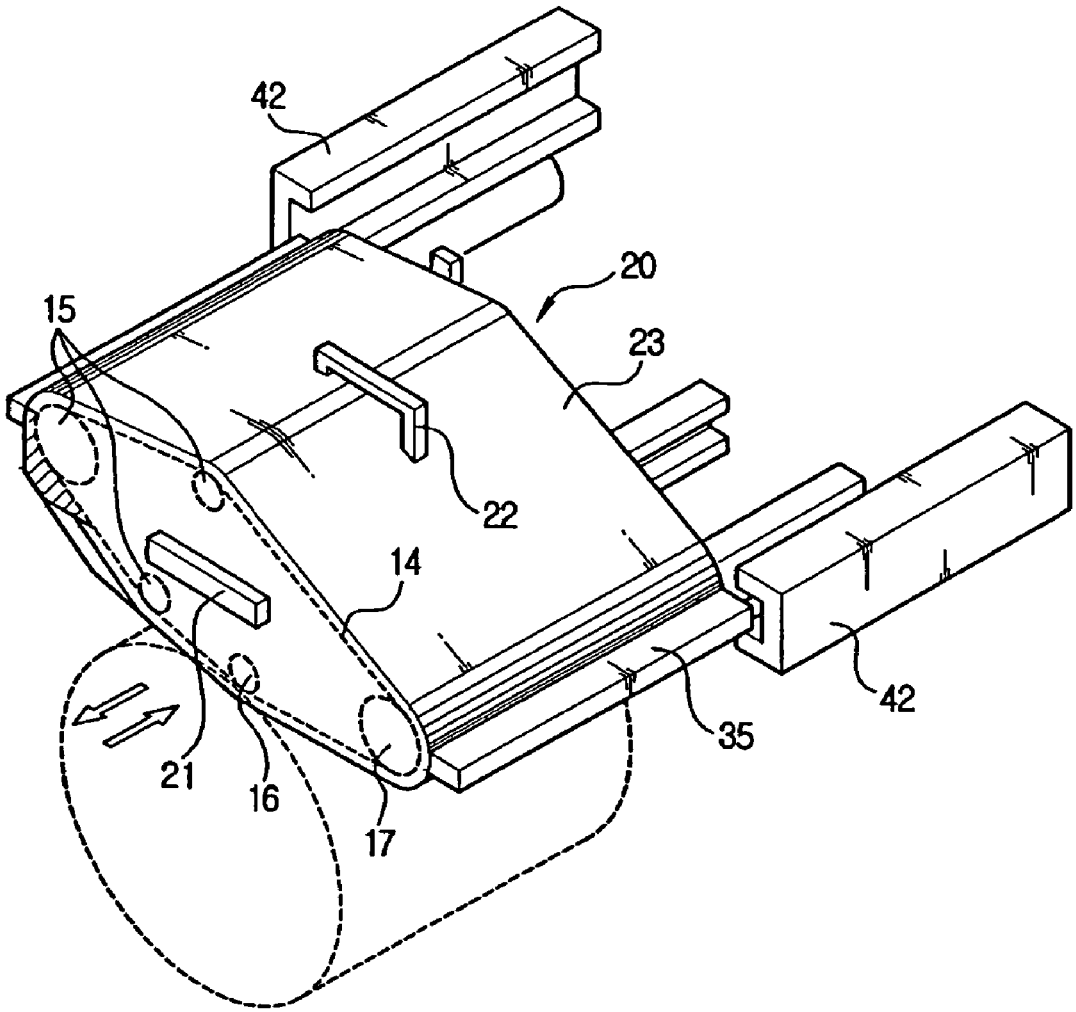
FIG. 2 (PRIOR ART)
FIG. 2 is a perspective view of the general conventional transfer unit of FIG. 1.

Reference will now be made in detail to the embodiments of the present general inventive concept, examples of which are illustrated in the accompanying drawings, wherein like reference numerals refer to the like elements throughout. The embodiments are described below in order to explain the present invention by referring to the figures.

Figure 3:
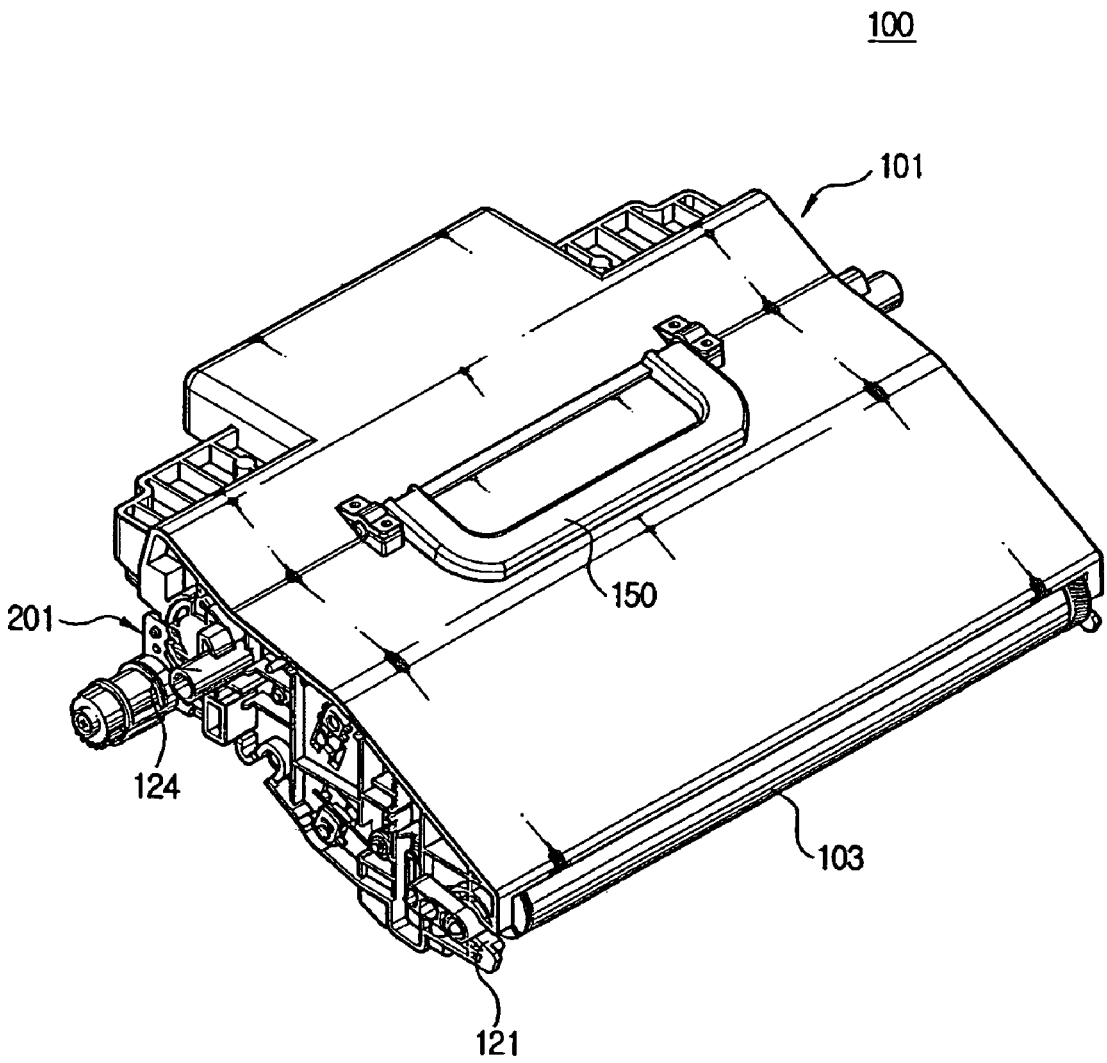
FIG. 3 is a perspective view of a transfer unit according to an embodiment of the present general inventive concept.
Figure 4:
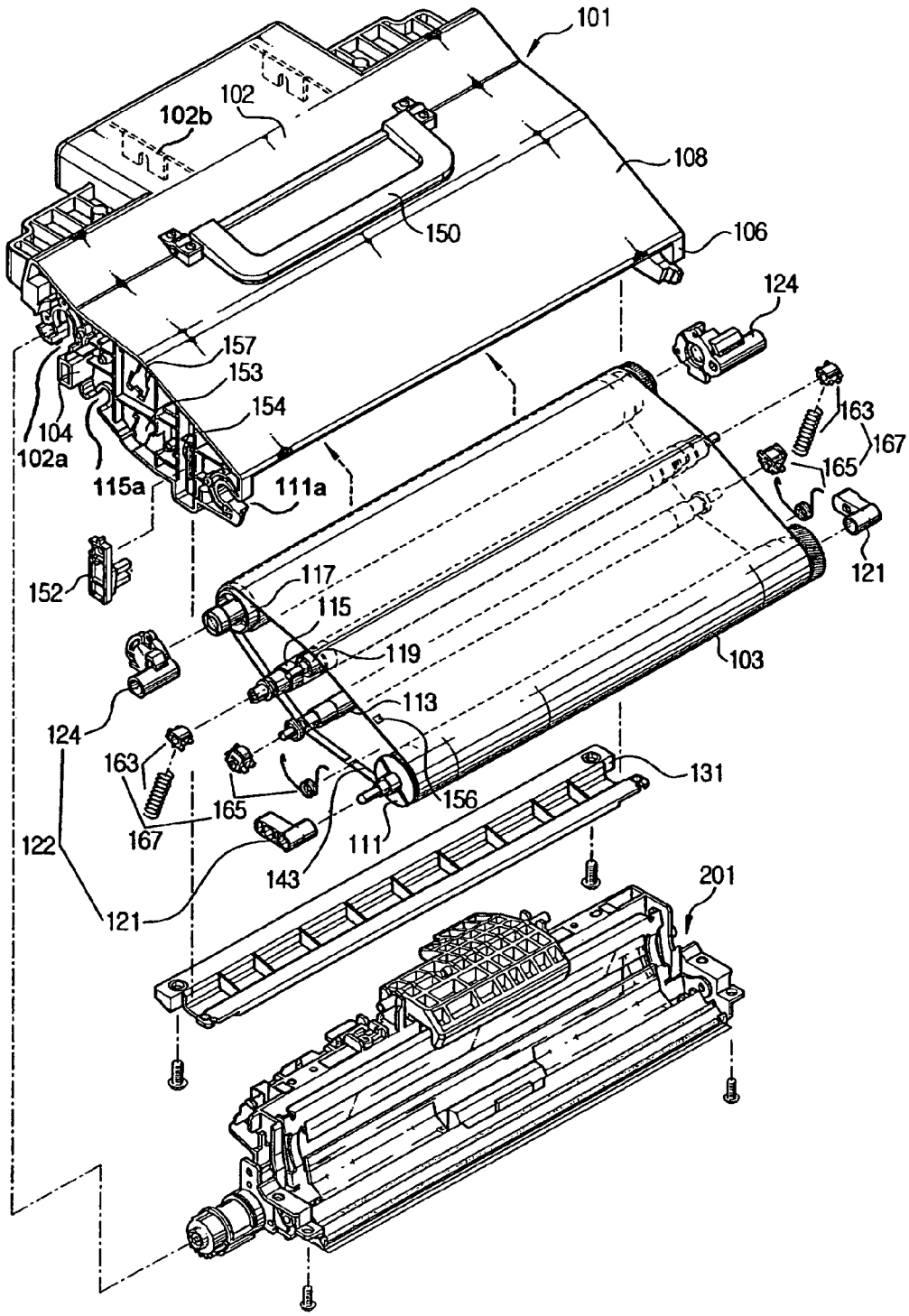
FIG. 4 is an exploded perspective view of the transfer unit of FIG. 3.
Figure 5:
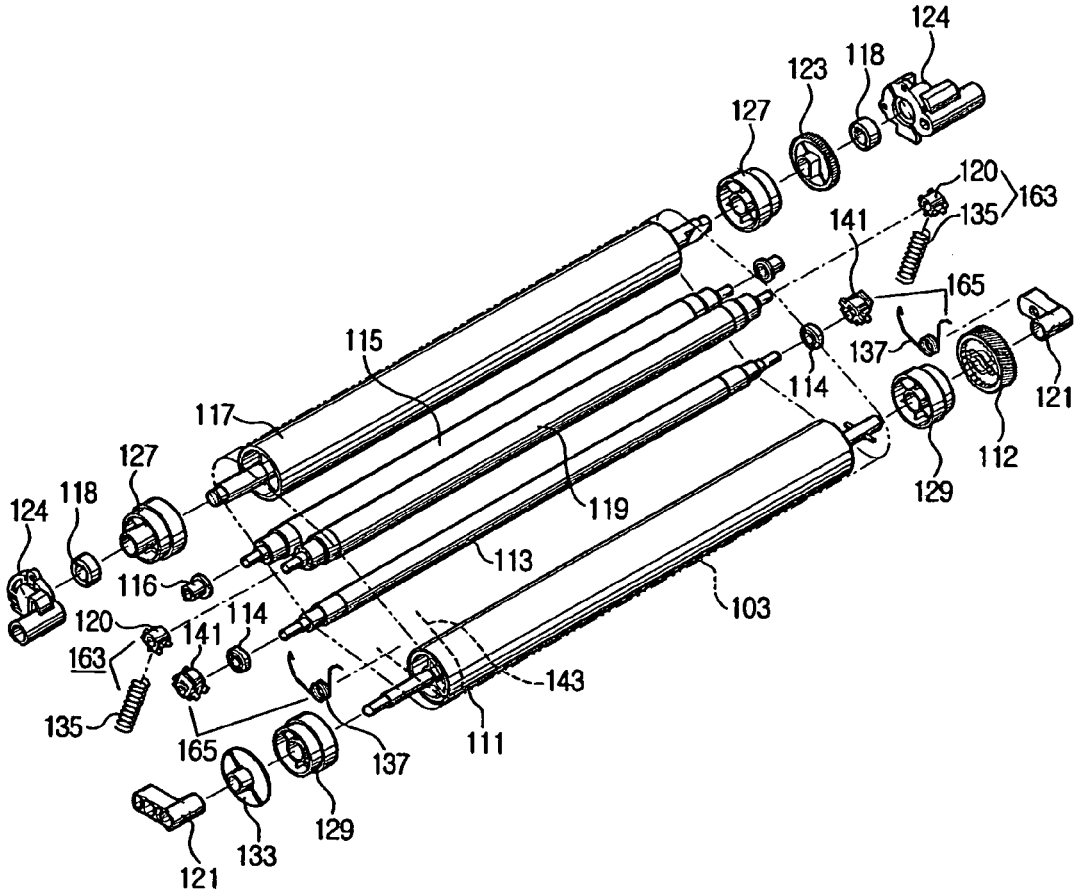
FIG. 5 is a view of main parts of the transfer unit of FIG. 4.

Referring to FIGS. 3 to 5, a transfer unit 100 according to an embodiment of the present general inventive concept may include an upper housing 101 and a lower housing and can be detachably connected to an image forming apparatus in a vertical direction.

The upper housing 101 may include a transfer belt 103 having an image forming surface of an endless track type. An upper surface of the upper housing 101 can be provided with a rotatable handle 150.

Figure 6:
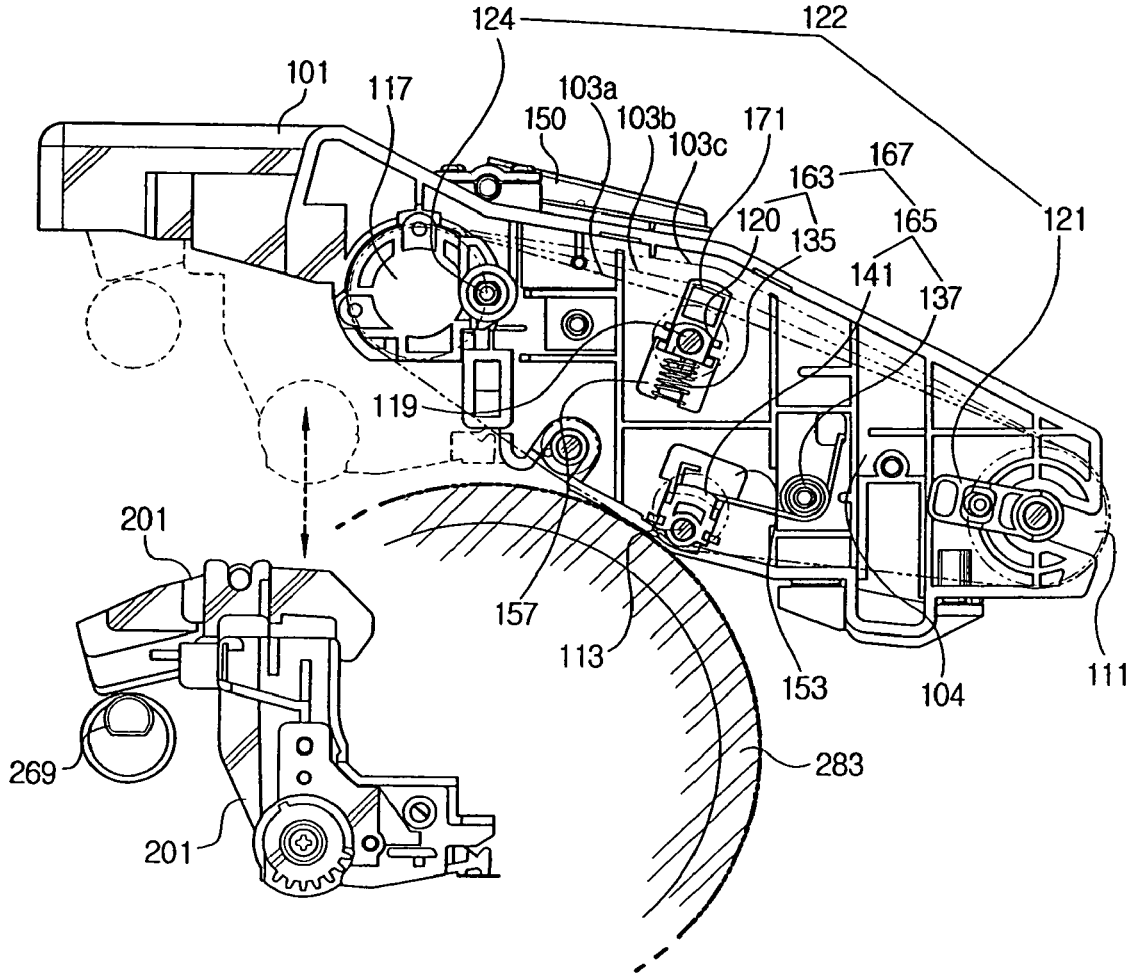
FIG. 6 is a side view of the transfer unit of FIG. 3.

An upper side of the upper housing 101 can be closed tightly, and a lower side of the upper housing 101 can be open. Therefore, as shown in FIG. 6, the upper housing 101 can become in contact with a photoconductive unit 283 which is disposed at a lower part of the transfer unit 100.

The lower housing 201 can be connected to the upper housing 101 and disposed to contact an image forming surface of the transfer belt 103.

Below, the upper housing 101 will be mainly described first, and then the lower housing 201 will be described, which is connected to the upper housing 101.

The upper housing 101 may include an upper housing body 102 and a transfer belt 103 mounted in the upper housing body 102. In the transfer belt 103, a plurality of rollers are mounted to drive the transfer belt 103. The upper housing body 102 may further include a first and a second vertical walls 104 and 106, and a cover wall 108 to enclose and protect a side of the transfer belt 103.

The transfer belt 103 may include therein a belt guide 143 to prevent the transfer belt 103 from escaping from an endless track thereof when being connected with the plurality of rollers. In addition, guide slots 157 and 153 can be formed at the first and second vertical walls 104 and 106 of the upper housing 101.

At a sensor mounting portion 154 formed at the upper housing 101, a sensor 152 can be provided. The sensor 152 may include a light emission part and a light reception part to sense a signal from a sensing mark 156 formed on the transfer belt 103. Here, according to the sensed signal, an initial point and a running position of the transfer belt 103 can be sensed.

Figure 7:
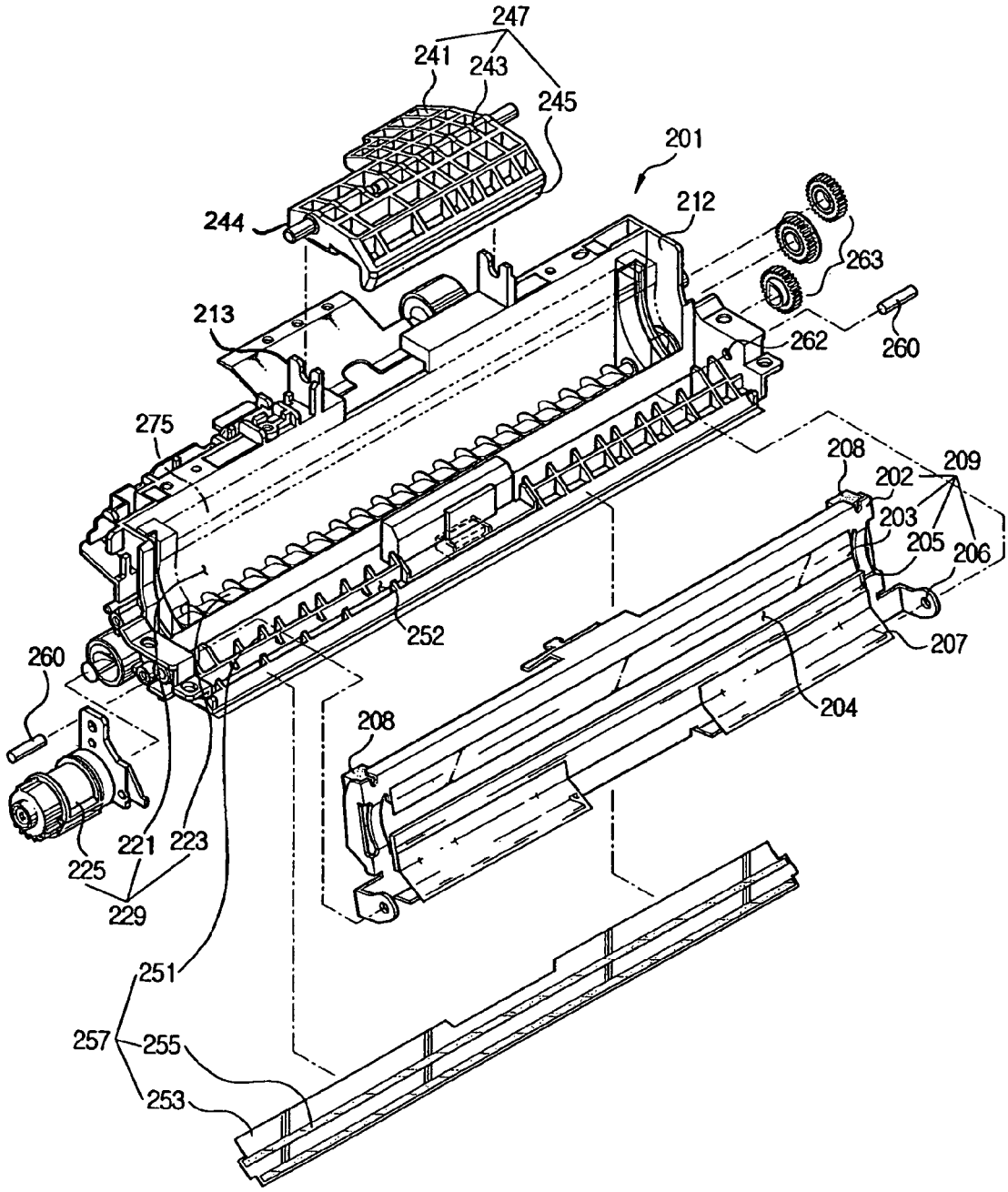
FIG. 7 is an exploded perspective view of a lower housing of the transfer unit of FIG. 4.

In addition, the upper housing 101 may include a support member 131 connected to the lower side of the upper housing 101 to supplement and reinforce the upper housing 101 since the upper housing 101 may have a weak structure due to its open lower side. The upper housing 101 may have first ribs **102*b* corresponding to second ribs 213 (FIG. 7) to receive a pin 244 (FIG. 7**).

Referring to FIGS. 4 and 5, the plurality of rollers may include a tension roller 119, a transfer roller 113, a drive roller 111, a nip roller 115, and at least one support roller 117. The first and second vertical walls 104 and 106 may have guide slots **102*a*, 115*a*, and 111*a* to receive ends of the support roller 117, the nip roller 115, and the drive roller 111**, respectively.

In the transfer belt 103, the tension roller 119 can control a tension of the transfer belt 103, can be mounted at the first and second vertical walls 104 and 106 of the upper housing 101, and can be disposed within the transfer belt 103. At both ends of the tension roller 119, a tension ring 120 can be formed respectively, and at the tension ring 120, an elastic member 135 can be formed to enable a connection between the upper housing 101 and the tension roller. In an aspect of this embodiment, the elastic member 135 can be a spring.

The transfer roller 113 can be disposed to correspond to the photoconductive unit 283 to transfer an image at the photoconductive unit 283 of FIG. 6 to the transfer belt 103. The transfer roller 113 may further include a transfer ring 114 and a tension ring 141 at both sides thereof to be connected to the upper housing 101. Here, the upper housing 101 can have an elastic member 137 to supply an elastic force to the tension ring 141.

The drive roller 111 can supply a driving force to the transfer belt 103 and transfer the image formed on the image forming surface of the transfer belt 103 to a transfer medium, such as a paper. At both sides of the drive roller 111, a bearing 129 can be formed to support the drive roller 111 which is in contact with the transfer belt 103. One of the drive roller bearings 129 can be connected to the upper housing 101 by a connection member 133, and the other drive roller bearing 129 can be connected to a driving gear 112. Further, a first guide member 121 can be connected to the connection member 133 and the driving gear 112, respectively. The first guide member 121 will be described later.

The support roller 117 can be rotated by the driving force of the drive roller 111 and can supply a driving force to a collecting unit 229 of the lower housing 201 that will be described later. A bearing 127 can be mounted at both sides of the support roller 117. At one end of the support roller 117, a backup ring 118 can be mounted to connect the support roller with the support roller bearing 127. At the other end of the support roller 117, a cleaning gear 123 can be mounted between the support roller bearing 127 and the backup ring 118.

The nip roller 115 can rotate and idle according to a rotation of the drive roller 111 and can have a gap ring 116 at both sides thereof to keep a predetermined distance between the transfer belt 103 and the photoconductive unit 283.

The bearings 127 and 129, the nip roller 115, the transfer roller 113, and the tension roller 119 can have a stepped portion to correspond to the belt guide 143.

Referring to FIG. 6, a plurality of guide members 122 and a plurality of tension members 167 can be formed at the first and second vertical walls 104 and 106 of the upper housing 101. Additionally, guide slots 157 and 153 to guide the tension members 167 can be formed at the first and second vertical walls 104 and 106 of the upper housing 101.

The plurality of guide members 122 can guide the transfer unit 100 when the transfer unit 100 is mounted to and separated from the image forming apparatus, and may have a first guide member 121 connected to both ends of one of the plural rollers and a second guide member 124 connected to both ends of another one of the plural rollers. In an aspect of the general inventive concept, the first guide member 121 can be mounted at both sides of the drive roller 111, and the second guide member 124 can be mounted at the support roller 117.

The plurality of tension members 167 may provide tension to the transfer belt 103 of the transfer unit 100 and may have a first tension member 165 and a second tension member 163.

The first tension member 165 mounted at the guide slot 153 to be connected with both sides of the transfer roller 113, can press the transfer roller 113 toward the photoconductive unit 283, and can include the tension ring 141 and an elastic member 137 which is mounted in the upper housing 101 to supply an elastic force to the tension ring 141.

The second tension member 163 can be mounted at the guide slot 157 to be connected to both ends of the tension roller 119 and can have the tension ring 120 and an elastic member 135 to supply an elastic force to the tension ring 120. A piece 171 can be disposed between the second tension member 163 and at least one of the first and second vertical walls 104 and 106 through the guide slot 157. That is, the piece 171 is inserted into a gap formed between the second tension member 163 and at least one of the first and second vertical walls 104 and 106 through the guide slot 157 to control the second tension member 163 to move in a direction away from the transfer belt 103 to reduce the tension applied to the transfer belt 103.

The piece 171 can control a spring tension of the second tension member 163 before the transfer unit 100 is mounted in the image forming apparatus. When mounting the transfer unit 100, the piece 171 is removed from the guide slot 157 to change the tension of the transfer belt 103.

More specifically, when the piece 171 is disposed at the guide slot 157, a tension of the transfer belt 103*a* can be, i.e., 80%. However, when the piece 171 is removed from the guide slot 157, the tension of the transfer belt 103*c* can become, i.e., 100%. When the transfer unit 100 is completely mounted and operated without the piece 171, the transfer belt 103*b* can have the tension of 90%. Thus, the tensions acted on the respective transfer belts 103*a*, 103*b*, 103*c* can be different according to each state.

Hereinafter, the lower housing 201 is described in detail with reference to FIG. 7.

The lower housing 201 can be connected to the upper housing 101. At a lower part of the lower housing 201 can be disposed an image density sensor 261 to sense density of the image of the photoconductive unit 283. Further, the lower housing 201 may include a lower housing body 212, a cleaning unit 209 mounted in the lower housing body 212, a pivot member 247, a scatter prevention unit 257, and a collecting unit 229.

At a side of the lower housing body 212 can be disposed a driving force transmitting unit 263 which has a plurality of rotatable gears operating in association with one another. The driving force transmitting unit 263 can be supplied with the driving force from any one of the plurality of rollers of the upper housing 101 and can transmit the driving force to the collecting unit 229.

The cleaning unit 209 can be movably mounted in the lower housing 201 to be selectively in contact with or separated from the transfer belt 103 and can have a bracket 202 having an opening 204, a sealing member 203, and a blade 205.

A hinge 206 is formed at both sides of the bracket 202. The hinge 206 can pivot in the lower housing 201 and can be connected to the lower housing 201 through a hinge hole 262. Here, the hinge 206 and the lower housing 201 are connected by a connection unit 260 through the hinge hole 262.

The blade 205 can be mounted at one side of the opening 204 of the bracket 202 to remove a toner formed at the transfer belt 103. The sealing member 203 can be formed at the other side of the opening 204 opposite to the blade 205 to prevent the toner, which is removed by the blade 205, from scattering.

In addition, at the bracket 202, a guide screen 207 can be formed at a lower part of the blade 205 opposite to the transfer belt 103 to guide a remaining toner on the transfer belt 103 to a certain direction when the removed toner is not collected through the opening 204.

Moreover, a second buffer member 208 can be formed at both sides of the bracket 202 where the lower housing 201 is connected.

The scatter prevention unit 257 can prevent the remaining toner from scattering in a case that a waste toner removed from the transfer belt 103 is not collected into the lower housing 201 through the cleaning unit 209, and can collect the waste toner.

The scatter prevention unit 257 may include a plurality of ribs 251 formed at the lower part of the lower housing 201, a scatter prevention screen 253 connected to the plurality of ribs 251, and an adsorption unit 255 formed at the scatter prevention screen 253.

The ribs 251 can be integrally formed with the lower housing 201 or can be made as an extra member detachably attached to the lower housing 201. Between the ribs 251 can be formed a rib space 252. The scatter prevention screen 253 can be connected to the ribs 251.

The adsorption unit 255 can be formed on a front of the scatter prevention screen 253 to face the transfer belt 103. The adsorption unit 255 can be formed right on the scatter prevention screen 253 or can be connected (attached) to the scatter prevention screen 253 as an extra member.

The pivot member 247 may include a pivot body 243, a pivot projection 245 formed at one side of the pivot body 243 toward the cleaning unit 209, and a cam projection 241 formed at the other side of the pivot body 243.

The pivot body 243 can be hingedly connected to the lower housing 201, and the cam projection 241 can become in contact with an eccentric cam 269 (FIGS. 6 and 8) which supplies a pivoting force to the pivot member 247 through the cam projection 241, and the pivot member 247 can periodically pivot according to a rotation of the eccentric cam 269. As the pivot member 247 pivots, the bracket 202 of the cleaning unit 209 can pivot to selectively contact the transfer belt 103. Therefore, the toner on the transfer belt 103 can be removed.

The collecting unit 229 can be mounted at the lower housing 201 to collect the waste toner that is removed at the cleaning unit 209, and can include a toner container 221, an auger 223 in the toner container 221, and a toner discharge member 225.

The toner container 221 can be formed in the lower housing 201, and the auger 223 is rotatably formed in the toner container 221. One side of the auger 223 can be connected to the driving force transmitting unit 263, and the other side of the auger 223 can be connected to the toner discharge member 225 to discharge the waste toner according to a rotation of the auger 223.

The toner discharge member 225 can discharge the waste toner which is transferred through the auger 223 to a toner storage unit (not shown). When the transfer unit 100 is not mounted in the image forming apparatus, the toner discharge member 225 can become airtight, and when the transfer unit 100 is mounted in the image forming apparatus, the toner discharge member 225 can be opened and connected to the toner storage unit (not shown).

Inside the lower housing 201, a first buffer member 275 can be formed to face the second buffer member 208 mounted at the cleaning unit 209. The first and the second buffer members 275 and 208 can press the cleaning unit 209 toward the transfer belt 103.

Figure 8:
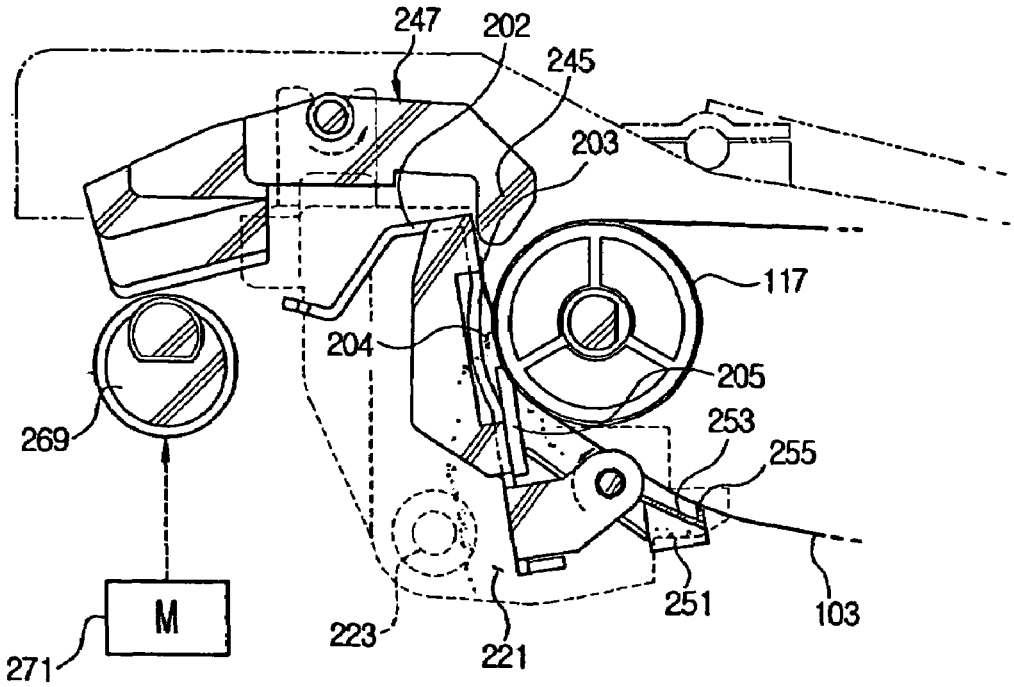
FIG. 8 is a view showing a cleaning operation of the transfer unit according to another embodiment of the present general inventive concept.

FIG. 8 is a view showing processes that the transfer unit 100 according to an embodiment of the present general inventive concept removes the toner from the transfer belt 103.

Referring to FIG. 8, the pivot member 247 can periodically pivot as the eccentric cam 269 rotates to transmit the driving force from a driving force generator 271 to the pivot number 247 through the cam projection 241. Then, according to the rotation of the pivot member 247, the bracket 202 can pivot. Accordingly, the blade 205 and the sealing member 203 can periodically move back and forth with respect to the transfer belt 103. Thus, a cleaning work is performed.

The waste toner, removed through the above process, can be collected through the opening 204 formed at the bracket 202. At this moment, the waste toner, uncollected through the opening 204, is collected into spaces between the ribs 251 of the scatter prevention unit 257 or adsorbed to the adsorption unit 255 of the scatter prevention screen 255.

On the other hand, the waste toner, flowing in through the opening 204 during the cleaning process, can be collected in the toner container 221 and discharged to the toner discharge member 225 through the auger 223 formed in the toner container 221.

Figure 9:
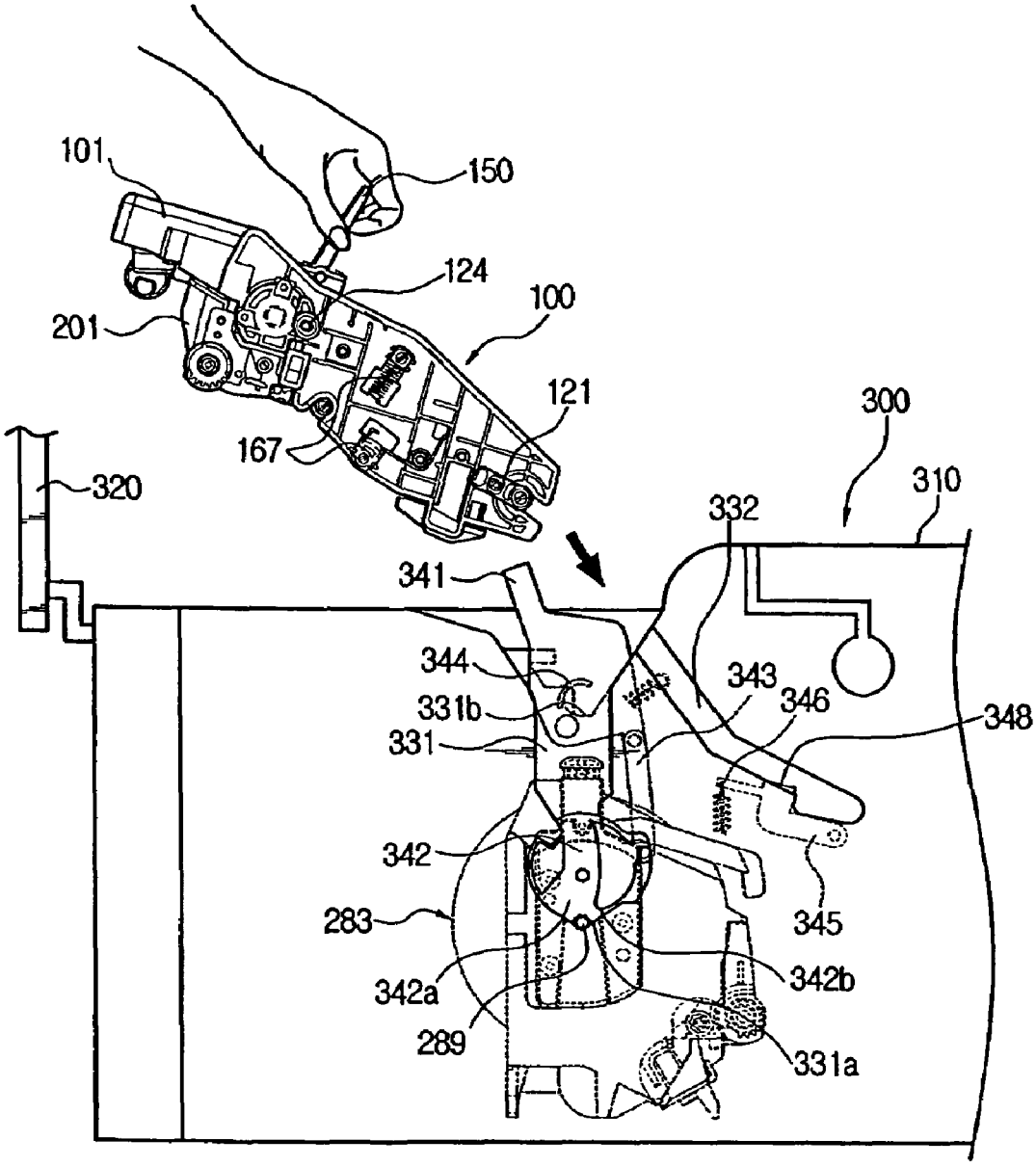
FIG. 9 is a view showing the transfer unit before being connected to the image forming apparatus.
Figure 10:
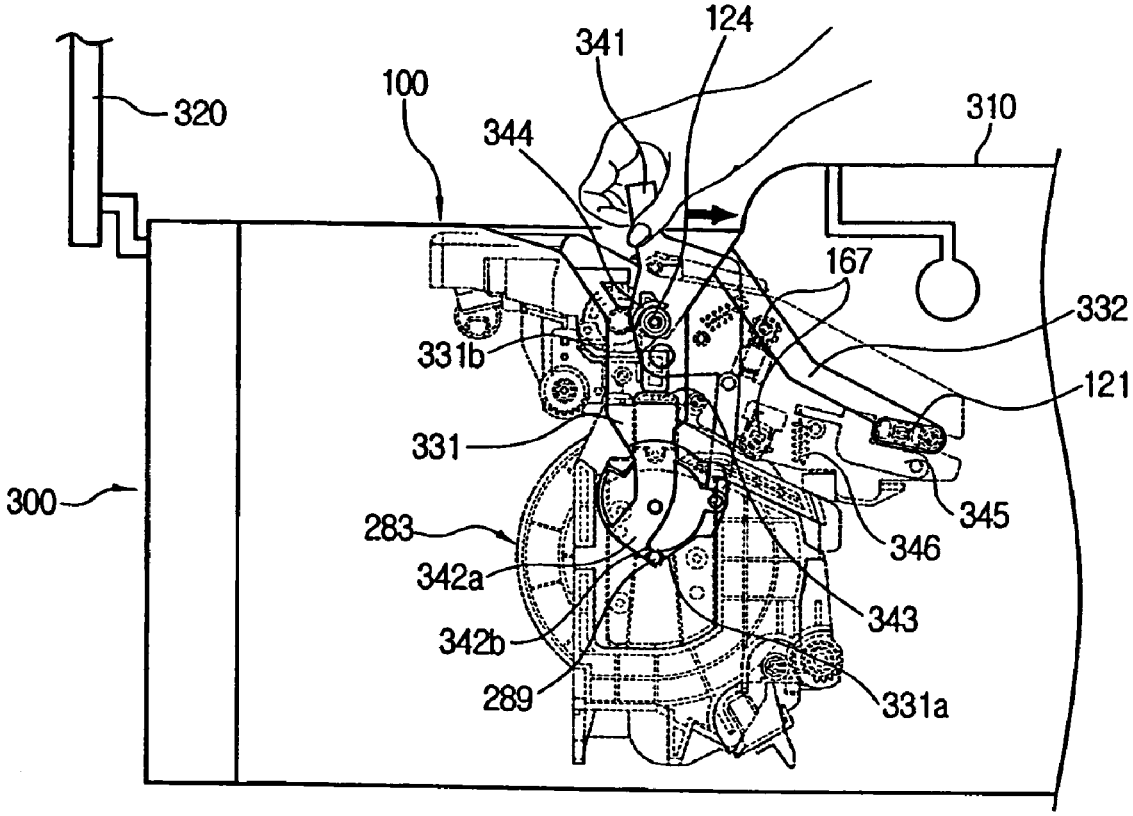
FIG. 10 is a view showing the transfer unit being connected to the image forming apparatus.

Hereinafter, a process of mounting the transfer belt having the above-described structure and operation in the image forming apparatus will be described. FIG. 9 is a view showing the transfer unit according to another embodiment of the present invention before being connected to the image forming apparatus, and FIG. 10 is a view showing the transfer unit according to another embodiment of the present invention after being connected to the image forming apparatus.

Referring to FIG. 9, an entrance can be formed at an upper part of a mounting portion of an image forming apparatus main body 300, which is opened and closed by a door 320. The replacement of the transfer unit 100 can be achieved through this entrance. In the mounting portion of the main body 300, a frame 310 can be formed having first and second guide rails 332 and 331. The second guide rail 331 can guide the second guide member 124 of the transfer unit 100, and the first guide rail 332 can guide the first guide member 121 of the transfer unit 100.

Since it is regarded that the photoconductive unit 283 is already mounted in the main body 300, detailed description thereof will be omitted.

The main body 300 can be provided with locking units to lock the transfer unit 100 mounted therein along first and second guide rails 332 and 331. The locking units are symmetrically formed at the frames 310 which are formed at both sides of the main body 300 in pair. The locking units can include a rotation lever 341, a rotation cam 342, and a connection bar 343 that connects the rotation lever 341 and the rotation cam 342 to be operated together.

The rotation lever 341 can be manually operated and can have a cover unit 344 at one side thereof to lock the second guide member 124 of the transfer unit 100 which will be securely received in an upper reception unit 331*b*.

The rotation cam 342 may include a rail unit 342*a* connected to the second guide rail 331 and may be rotatably mounted in the frame 310. The rotation cam 342 may further include a pressing unit 342*b* to lock a guide member 289 of the photoconductive unit 283 received in a lower reception unit 331*a*.

Therefore, the above mounting process is as follows. The photoconductive unit 283 is mounted in the main body 300, and the transfer unit 100 can be mounted in the main body 300 along the first and second guide rails 332 and 331. If the rotation lever 341 is rotated, the pressing unit 342*b* of the rotation cam 342 can lock the photoconductive unit 283 by pressing down the guide member 289 of the photoconductive unit 283. At the same time, the cover unit 344 of the rotation lever 341 can cover and lock the second guide member 124 of the transfer unit 100.

In the meantime, the first guide rail 332 is mounted with an auxiliary locking unit to lock the first guide member 121 of the transfer unit 100. The auxiliary locking unit may include an interference lever 345 rotatably formed at the frame 310 and a spring 346 to elastically bias a free end 348 of the interference lever 345 to project toward the first guide rail 332.

The free end 348 of the interference lever 345 can have a sloping surface to allow the first guide member 121 to smoothly climb over the sloping surface of the interference lever 345 when going down along the first guide rail 332, and a stepped surface to allow the first guide member 121 to be obstructed by the first guide rail 332 when moving along the guide rail 332.

In the above structure, to connect the transfer unit 100 to the main body 300 of the image forming apparatus wherein the photoconductive unit 283 is mounted, the first guide member 121 of the transfer unit 100 connected to the upper and lower housings 101 and 201, is mounted in the image forming apparatus by sliding along the first guide rail 332. Here, the first guide member 121 can be received in the first guide rail 332 by climbing over the free end 348 of the interference lever 345.

After the first guide member 121 is completely mounted, the second guide member 124 can be inserted into the second guide rail 331 to be received in the upper reception unit 331*b*. The mounting of the transfer unit 100 is thus finished, and then, a locking process follows to securely fixedly couple the transfer unit 100 to the main body 300.

In order to lock the transfer unit 100, the rotation lever 341 can be rotated. As shown in FIG. 10, if a user rotates the rotation lever 341 to a locking state, the cover unit 344 of the rotation lever 341 can cover the second guide member 124 to prevent the second guide member 124 of the transfer unit 100 from escaping upward, and the pressing unit 342*b* of the rotation cam 342 can press the guide member 289 of the photoconductive unit 283 toward the lower reception unit 331*a* to securely lock the guide member 289. Therefore, as long as the user does not return the rotation lever 341 to an initial state from the locking state, the transfer unit 100 can be maintained in the locking state by the locking unit. Here, a plurality of tension members 167 can elastically control the relative position of the transfer unit 100 with respect to a contacting object, such as the photoconductive unit 283, in the main body 300, and accordingly, can also control the tension of transfer belt 103 of the transfer unit 100.

When separating the transfer unit 100, the user can open the door 320 and rotate the rotation lever 341 to an unlocking state, that is, the initial state. The user can separate the photoconductive unit 283 as necessary.

Thus, the above-structured transfer unit 100 can be facile to be connected to and separated from the main body 300, and at this time, by the presence of the plurality of tension members 167, the relative position of the transfer unit 100 can be controlled since the transfer unit 100 is elastically in contact with the contacting object, such as the photoconductive unit 283.

As described above, the transfer unit 100 according to the present general inventive concept is convenient to mount and separate in a vertical direction, and therefore, the replacement becomes also facile.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A transfer unit used with an image forming apparatus having a main body and a photoconductive unit mounted therein, comprising:

an upper housing including a transfer belt of an endless track structure to transfer an image from the photoconductive unit of the main body of the image forming apparatus, and a plurality of rollers to support the transfer belt and move therein; and a lower housing removably connected to the upper housing, and having a cleaning unit to clean the transfer belt, wherein the transfer unit is removably mounted to the main body of the image forming apparatus in a vertical direction to be positioned above the photoconductive unit in the main body.

2. The transfer unit of claim 1, wherein the upper housing and the lower housing are connected to each other when being mounted in a mounting portion of the main body of the image forming apparatus.

3. The transfer unit of claim 1, wherein the plurality of rollers comprises:

a transfer roller disposed to correspond to the photoconductive unit;

a drive roller disposed to correspond to a transfer medium to which the image is transferred from the transfer belt;

a tension roller to control a tension of the transfer belt;

a nip roller to rotate idle according to a rotation of the drive roller; and at least one support roller to support the transfer belt.

4. The transfer unit of claim 3, wherein the upper housing comprises an upper housing body having:

a first and a second vertical walls to rotatably support the respective rollers; and a cover wall to connect the first and second vertical walls, and to enclose a side of the transfer belt for protection.

5. The transfer unit of clam 4, wherein the first and second vertical walls comprise a guide slot to guide a movement of the tension roller.

6. The transfer unit of claim 5, wherein the plurality of rollers are mounted in the guide slot, and the upper housing comprises a tension member to control the tension of the transfer belt.

7. The transfer unit of claim 6, further comprising:

a piece disposed between the tension member and the guide slot to control the tension of the transfer belt.

8. The transfer unit of claim 7, wherein the tension of the transfer belt is smaller when the piece is mounted in the transfer unit, than when the piece is removed from the transfer unit.

9. The transfer unit of claim 4, wherein the upper housing comprises a guide slot formed on the first and second vertical walls to support the plurality of rollers and a tension member to control the tension of the transfer belt.

10. The transfer unit of claim 9, further comprising a piece disposed between the tension member and the guide slot to control the tension of the transfer belt.

11. The transfer unit of claim 10, wherein the tension of the transfer belt is smaller when the piece is mounted in the transfer unit, than when the piece is removed from the transfer unit.

12. The transfer unit of claim 3, wherein the upper housing comprises a guide slot formed on the first and second vertical walls and a tension member to control the tension of the transfer belt.

13. The transfer unit of claim 12, further comprising:

a piece disposed between the tension member and the guide slot to control the tension of the transfer belt.

14. The transfer unit of claim 13, wherein the tension of the transfer belt is smaller when the piece is mounted in the transfer unit, than when the piece is removed from the transfer unit.

15. The transfer unit of claim 3, wherein the upper housing further comprises a tension member to press the transfer roller toward the photoconductive unit.

16. The transfer unit of claim 3, wherein the upper housing comprises a gap ring formed at both ends of the transfer roller to maintain a contacting distance between the transfer belt and the photoconductive unit.

17. The transfer unit of claim 1, wherein the upper housing further comprises a guide member to guide the transfer unit to a mounting position of the main body when being mounted in the main body of the image forming apparatus.

18. The transfer unit of claim 17, wherein the guide member comprises:

a first guide member connected to both ends of one of the rollers; and a second guide member connected to both ends of another one of the rollers.

19. The transfer unit of claim 1, wherein the upper housing has a rotatable handle member rotatably connected to an upper part thereof.

20. The transfer unit of claim 1, wherein the upper housing further comprises a sensor to sense a running position of the transfer belt.

21. The transfer unit of claim 1, wherein the lower housing comprises:

a lower housing body connected to a lower part of the upper housing, and supporting the cleaning unit;

a collecting unit mounted in the lower housing body to collect a cleaned waste toner; and an image density sensor mounted at a lower part of the lower housing body, and sensing to sense density of the image of the photoconductive unit.

22. The transfer unit of claim 21, wherein the cleaning unit is movably mounted in the lower housing body to be selectively in contact with or separated from the transfer belt, and the lower housing body comprises a pivot member to drive the cleaning unit.

23. The transfer unit of claim 21, wherein the lower housing further comprises a driving force transmitting unit having a plurality of rotatable gears to operate in association with one another at a side of the lower housing body and to transmit a driving force from one of the rollers of the upper housing to the collecting unit.

24. The transfer unit of claim 1, wherein the cleaning unit is movably mounted in the lower housing.

25. A transfer unit used with an image forming apparatus, comprising:

an upper housing having an upper housing body, first and second walls extended from first and second positions of the upper housing body, respectively, to form an opening with the upper housing body, and a plurality of guide slots formed on the first and second walls;

a transfer belt having an endless tack structure and disposed in the opening;

a plurality of rollers each having ends disposed in corresponding ones of the guide slots to support the transfer belt;

a plurality of guide members connected to ends of the plurality of rollers; and a lower housing detachably connected to the upper housing and having a cleaning unit to clean the transfer belt, the cleaning unit including an auger rotatably disposed inside the lower housing to move waste toner away from the transfer belt according to the rotation thereof, wherein:

at least one of the plurality of rollers comprises a tension roller having ends disposed in the corresponding guide slot, and the corresponding guide slot guides the movement of the tension roller, and the guide members serve to guide the transfer unit to be removably mounted along a vertical direction with respect to a main body of the image forming apparatus to a position that is above the photoconductive unit.

26. The transfer unit of claim 25, wherein the rollers comprises a support roller and a drive roller to support the transfer belt in a first direction, and a transfer roller and a tension roller disposed between the support roller and the drive roller to support the transfer belt in a second direction, and the upper housing comprises a handle rotatably coupled to the upper housing body at a position disposed between rotating axes of the support roller and the drive roller.

27. The transfer unit of claim 26, wherein the upper housing comprises a handle rotatably coupled to the upper housing body at a position disposed between the support roller and the drive roller.

28. The transfer unit of claim 25, wherein the rollers comprises a transfer roller, a support roller, a drive roller, the tension roller, and a nip roller, and the guide slots comprises first and second guide slots formed on a middle portion of the first and second walls to receive the transfer roller and the tension roller, respectively, and third, fourth, and fifth guide slots formed on an outer circumferential portion of the first and second walls to receive the support roller, the drive roller, and the nip roller, respectively.

29. The transfer unit of claim 28, wherein the third, fourth, and fifth guide slots have an open structure.

30. The transfer unit of claim 28, wherein the first and second guide slots have an area larger than that of ends of the transfer roller and the tension roller, respectively, so that the ends of the transfer roller and the tension roller are movably disposed in the first and second guide slots, respectively.

31. The transfer unit of claim 28, further comprising:

a first ring disposed in the first guide slot to connect the transfer roller to the upper housing;

a second ring disposed in the second guide slot to connect the tension roller to the upper housing;

a first tension member to bias the transfer roller in a first direction; and a second tension member to bias the tension roller in a second direction different from the first direction.

32. The transfer unit of claim 31, wherein the transfer belt has a tension varying according to variation of an elastic force of one of the first and second tension members.

33. The transfer unit of claim 31, further comprising:

a piece disposed to control the second tension member to change a position of the tension roller with respect to the transfer roller, wherein the transfer belt has one of first and second tension values according to existence of the piece.

34. The transfer unit of claim 25, wherein the guide slots comprises a first group of slots formed in a middle portion of the first and second walls to have a closed shape, and a second group of slots formed in an outer circumferential portion of the first and second walls to have an open shape, and the ends of the rollers are disposed in one of the first and second groups of slots.

35. The transfer unit of claim 25, wherein the lower housing comprises a collecting unit to communicate with the cleaning unit to collect a toner removed from the transfer belt by the cleaning unit and discharge the collected toner into an outside of the transfer unit, and the first and second walls comprise a collecting unit coupling slot to receive a portion of the collecting unit, and a coupling element to couple a portion of the lower housing to at least one of the first and second walls.

36. The transfer unit of claim 35, wherein the portion of the collecting unit comprises a toner discharging member through which the collected toner is discharged.

37. The transfer unit of claim 25, wherein one of the rollers comprises a transfer roller, and the upper housing comprises a sensor disposed opposite to the cleaning unit with respect to the transfer roller to sense a portion of the transfer unit.

38. The transfer unit of claim 25, wherein:

the rollers comprises a drive roller and a support roller; and the upper housing comprises a first guide member and a second guide member to couple the drive roller and the support roller to first and second walls, respectively, and to guide the transfer unit within the image forming apparatus when the transfer unit is installed to or removed from the image forming apparatus.

39. The transfer unit of claim 25, wherein the image forming apparatus comprises a photoconductive unit to generate a developed image to be transferred to a portion of the transfer belt, and the transfer unit is installed to the image forming apparatus in a direction having an angle with a line passing through a center of the photoconductive unit and the portion of the transfer unit.

40. The transfer unit of claim 39, wherein the angle is less than 90°.

41. The transfer unit of claim 39, wherein the direction is not parallel to longitudinal axes of the rollers about which the respective rollers rotate.

42. The transfer unit of claim 25, wherein the cleaning unit is movably mounted in the lower housing.

43. An image forming apparatus comprising:

a main body enclosing an inner space and having first and second guide rails;

a photoconductive unit disposed inside the enclosed inner space of the main body; and a transfer unit comprising, an upper housing including a transfer belt of an endless track structure to transfer an image from the photoconductive unit of the main body, and a plurality of rollers to support the transfer belt to move therein, and a lower housing removably connected to the upper housing, and having a cleaning unit to clean the transfer belt, wherein the transfer unit is removably mounted along a vertical direction to the enclosed inner space of the main body along the first and second guide rails to a position that is above the photoconductive unit.

44. The image forming apparatus of claim 43, wherein the cleaning unit is movably mounted in the lower housing.

45. An image forming apparatus, comprising:

a main body having first and second guide rails; and a transfer unit comprising, an upper housing having an upper housing body, first and second walls extended from first and second positions of the upper housing body in a mounting direction , respectively, to form an opening with the upper housing body, and a plurality of guide slots formed on the first and second walls, a transfer belt having an endless tack structure, disposed in the opening, a plurality of rollers each having ends disposed in corresponding ones of the guide slots to support the transfer belt, and a lower housing detachably connected to the upper housing, and having a cleaning unit to clean the transfer belt, wherein the transfer unit is removably mounted to the main body along the first and second guide rails in the mounting direction and the transfer unit comprises a portion to receive an image from the photoconductive unit, and the transfer unit is installed to the image forming apparatus in a direction passing through a center of the photoconductive unit and the portion of the transfer unit.

46. The image forming apparatus of claim 45, wherein one of the rollers comprises a transfer roller to transfer an image from the photoconductive unit to the transfer belt, and the upper housing comprises a sensor disposed opposite to the cleaning unit with respect to the a portion of the transfer unit.

47. The image forming apparatus of claim 45, wherein:

the rollers comprise a drive roller and a support roller; and the upper housing comprises a first guide member and a second guide member to couple the drive roller and the support roller to first and second walls, respectively, and to guide the transfer unit within the image forming apparatus when the transfer unit is installed to or removed from the image forming apparatus.

48. The image forming apparatus of claim 47, wherein the photoconductive unit generates a developed image to be transferred to a portion of the transfer belt, and the transfer unit is installed to the image forming apparatus in a direction having an angle with a line passing through a center of the photoconductive unit and the portion of the transfer unit.

49. The image forming apparatus of claim 45, wherein the roller comprises a drive roller and a support roller, the transfer unit comprises a first guide member and a second guide member to connect the drive roller and the support roller to corresponding ones of the first and second walls through corresponding ones of the guide slots to be disposed in the first and second guide rails, respectively, when the transfer unit is installed to the image forming apparatus.

50. The image forming apparatus of claim 45, wherein the first and second guide rails comprises a common entrance disposed on a portion of the main body in the mounting direction from the photoconductive unit.

51. The image forming apparatus of claim 45, wherein the cleaning unit is movably mounted in the lower housing.

52. A transfer unit usable with an image forming apparatus, the transfer unit comprising:

an endless transfer belt to be rotated by one or more rollers, the transfer belt including an upper portion and a lower portion;

an upper housing to enclose the upper portion of the transfer belt;

a plurality of guide members connected to ends of the one or more rollers; and a lower housing removably connected to the upper housing to enclose less than half of the lower portion adjacent to the upper housing such that more than half of the lower portion of the transfer belt remains exposed, wherein the guide members serve to guide the transfer unit to be mounted to a main body of the image forming apparatus in a vertical direction to be positioned above a photoconductive unit in the main body.

53. An image forming apparatus, comprising:

a frame defining a space;

a photoconductive unit mounted in the defined space and on which an electrostatic latent image is formed;

a transfer unit removably mounted above the photoconductive unit in the defined space along a vertical direction; and an image density sensor mounted at a lower part of the defined space to sense a density of the image of the photoconductive unit, wherein the transfer unit comprises:

a lower housing removably connected to an upper housing to house a transfer belt therebetween, a plurality of rollers to support the transfer belt, and a plurality of guide members connected to ends of the plurality of rollers to guide a vertical mounting of the transfer unit to a main body of the image forming apparatus to a position that is above the photoconductive unit.

* * * * *